US008409026B2

(12) United States Patent
Riddle

(10) Patent No.: US 8,409,026 B2
(45) Date of Patent: Apr. 2, 2013

(54) GOLF PUTTER WITH TRAMPOLINE-EFFECT DRUMHEAD STRIKING SURFACE AND PENDULUM PLUMB-BOB PERIPHERAL WEIGHT DISTRIBUTION

(76) Inventor: William A. Riddle, Kaneohe, HI (US)

( * ) Notice: Subject to any disclaimer, the term of this patent is extended or adjusted under 35 U.S.C. 154(b) by 363 days.

(21) Appl. No.: 12/877,982

(22) Filed: Sep. 8, 2010

(65) Prior Publication Data

US 2012/0058837 A1 Mar. 8, 2012

(51) Int. Cl.
*A63B 69/36* (2006.01)
*A63B 53/04* (2006.01)

(52) U.S. Cl. ..... 473/251; 473/255; 473/329; 473/340; 473/349; 473/350

(58) Field of Classification Search ..... 473/324–350, 473/251–256, 313, 314; D21/736–746
See application file for complete search history.

(56) References Cited

U.S. PATENT DOCUMENTS

| | | | | | |
|---|---|---|---|---|---|
| 4,113,249 | A * | 9/1978 | Beery | 473/329 |
| 4,138,117 | A * | 2/1979 | Dalton | 473/255 |
| 4,679,792 | A * | 7/1987 | Straza et al. | 473/329 |
| 4,871,174 | A * | 10/1989 | Kobayashi | 473/252 |
| 4,964,639 | A * | 10/1990 | Tucker | 473/255 |
| 5,064,197 | A * | 11/1991 | Eddy | 473/326 |
| 5,342,052 | A * | 8/1994 | Costa | 473/329 |
| 5,464,212 | A * | 11/1995 | Cook | 473/329 |
| 5,499,814 | A * | 3/1996 | Lu | 473/329 |
| 5,643,109 | A * | 7/1997 | Rose et al. | 473/329 |
| 5,993,324 | A * | 11/1999 | Gammil | 473/251 |
| 6,083,115 | A * | 7/2000 | King | 473/252 |
| 6,488,594 | B1 * | 12/2002 | Card et al. | 473/340 |
| 6,702,689 | B2 * | 3/2004 | Ashton | 473/251 |
| 6,929,564 | B2 * | 8/2005 | Olsavsky et al. | 473/340 |
| 7,278,926 | B2 * | 10/2007 | Frame | 473/329 |
| 7,566,276 | B2 * | 7/2009 | Billings | 473/251 |
| 2006/0148585 | A1 * | 7/2006 | Vinton | 473/340 |
| 2007/0155524 | A1 * | 7/2007 | Cameron | 473/251 |

* cited by examiner

*Primary Examiner* — Sebastiano Passaniti
(74) *Attorney, Agent, or Firm* — Leighton K. Chong

(57) ABSTRACT

An improved design for a golf putter has a putter head with a back surface formed in an elliptical shape elongated along a transverse axis normal to a swing plane for the putter, enclosing a hollow interior and having a circumferential rim forming an elliptical frame for the putter head. A head striking surface is formed with a sheet of taut, resilient material secured to the elliptical frame providing a trampoline-like drumhead effect when it makes contact with a golf ball that tends to return the ball's rolling trajectory to the target line of the swing axis even if contact is made off-center. The putter body is an elongated tubular body oriented in the direction of the swing axis, so that the peripheral weight of the putter is aligned along the swing axis and creates a pendulum plumb-bob effect of weight moving under gravity aligned in the swing direction. The front end of the tubular body is fitted through a central aperture in the back surface of the putter head and abuts the taut, resilient sheet material to form a circular "sweet spot" on the head striking surface.

18 Claims, 6 Drawing Sheets

GOLF PUTTER WITH TRAMPOLINE-EFFECT DRUMHEAD STRIKING SURFACE AND PENDULUM PLUMB-BOB PERIPHERAL WEIGHT DISTRIBUTION

TECHNICAL FIELD

This patent application is directed to an improved golf putter design, and particularly to one having a trampoline-effect drumhead surface and using a pendulum plumb-bob weight distribution.

BACKGROUND ART

Many different types of golf putters have been designed in an attempt to give its user some slight advantage in putting for the excruciatingly difficult and exacting game of golf. Early putters had a thin, elongated L-shaped head made of hard wood or metal. These early putters were a simple extension in design from the standard shape of "irons" of the day. Contemporary putter designs have generally evolved from those early designs. Today they employ advanced materials for their putter head surfaces, such as high tensile strength metals and bi-metals and or inlaid high-density plastics or composites. Some modern putters have developed elaborate layouts for distributing weight along the head on the crosswise axis, and more recent designs have even added weight to the outside-edges to counteract the torsion-twisting physics which naturally occurs due to the weight being located in the transverse axis.

Since the previous putter head designs all attempted to provide a uniform hard striking surface on the putter head, the effect has been that if the golfer swings slightly off line, the contact point on the head surface strikes the ball off-center. Consequently the rolling trajectory of the ball would tend to correspondingly deviate from the target line of the swing. Additionally, present putter head designs provide a head striking surface that has a vertical height above the ground only slightly above the height of the forward circumferential contact point on the ball (0.84 inches high). Therefore, striking the ball in the center "sweet spot" of the vertical axis of the putter face is extremely difficult. As a result, a swing by the user that traverses slightly higher than the designed clearance height of the head to be swung above the ground will result in topping the ball, causing it to dive into the ground, whereas a swing that traverses slightly lower than the designed clearance height of the head may result in undercutting the ball, causing it to hop or bobble. None of these prior designs provides a head striking surface and head design that tends to return the rolling trajectory of the ball to the target line of the swing if contact is made with the ball slightly off-center on the head surface.

SUMMARY OF INVENTION

The present invention seeks to overcome the deficiencies of prior golf putters by providing a head striking surface and shape that tends to return the ball trajectory to the target line of the swing even if contact is made with the ball slightly off-center. The invention comprises a golf putter having a putter head formed in an elliptical shape elongated along a transverse axis to the swing plane and having a height along a vertical axis that is equal to or greater than the height of a standard golf ball. The putter head has a hollow interior with no material other than its forward head striking surface to be applied in striking the golf ball. The head striking surface is formed with a sheet of taut, resilient material that is secured to an elliptical frame formed by the circumference of the putter head around its hollow interior. With this putter head design, the head striking surface has a trampoline-like drum effect when it makes contact with the ball and tends to return the ball's rolling trajectory to the target line of the swing even if contact with the ball is made off-center.

Another aspect of the present invention is that the body of the putter consists of a hollow and elongated tubular body having its tubular axis oriented in the direction of the swing axis of the putter head, rather than the weight distribution of typical putter bodies along the transverse axis to the swing plane. This new design enables the peripheral weight of the putter to be aligned in the direction of the swing axis, in order to create a pendulum plumb-bob effect of its weight moving under gravity effect aligned in the swing direction, thereby facilitating a smooth consistent swing.

The tubular body has provision for adjusting the overall weight and weight distribution of the putter head to have an appropriate swing weight for good stability and "feel" for any individual's putt swing. In a preferred design, the adjustable weighting includes telescoped front and/or back tube sections that sleeve over (or inside) respective ends of the tubular body. The telescoped tube sections can be formed with different section lengths, wall thicknesses, and/or materials depending on the desired weight and distribution between front and back portions of the putter body. The tubular body is joined at its midsection to a centered hosel for connecting to a putter shaft.

In the preferred design, the front end of the tubular body is fitted through a central aperture in a back part of the putter head and has its circumferential rim abutting the back of the taut, resilient sheet material forming the head striking surface. This tubular front end rim is adhered to the back of the sheet material, thereby forming a large circular "sweet spot" with a circular profile that is that is equal to or greater than the profile of the standard golf ball (1.68 inches in diameter). This large "sweet spot" allows plenty of leeway for the head striking the ball off-center and yet providing a rebound trajectory toward the target line of the swing due to the trampoline-effect of the striking surface. The back end of the tubular body is open to air, so that the trampoline-like effect of the resilient sheet forming the head striking surface is optimized for air pressure balance. In addition, the orientation of the weighted tubular body and telescoped tube sections as added weights along the swing axis places all of the putter's weight moving peripherally along the line of the swing, so that any tendency to torquing of the putter head is minimized even if contact with the ball is made slightly off-center or off the swing axis.

Other objects, features, and advantages of the present invention will be explained in the following detailed description of the invention having reference to the appended drawings.

DETAILED DESCRIPTION

Figure 1:
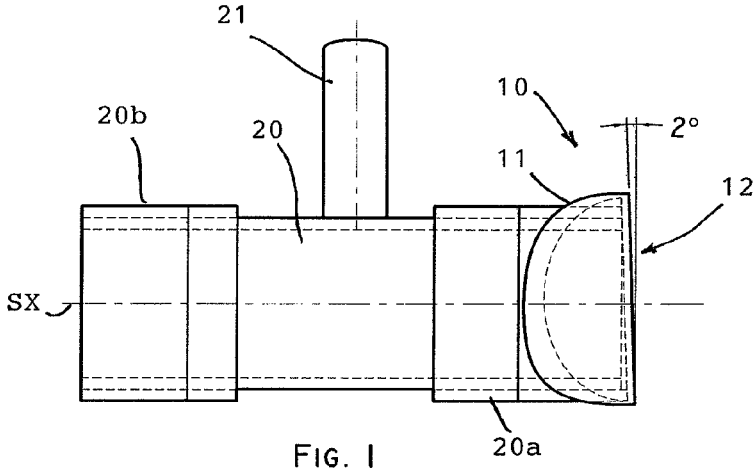
FIG. 1 is a right side view of the improved golf putter design.

In the following detailed description of the invention, certain preferred embodiments are illustrated providing certain specific details of their implementation. However, it will be recognized by one skilled in the art that many other variations and modifications may be made given the disclosed principles of the invention.

FIGS. 1-7B illustrate the improved golf putter design of the present invention. The putter has a head 10 formed in an elliptical shape elongated along a transverse axis TX which is oriented crosswise (normal) to the swing axis SX. The head has a back surface 11 enclosing a hollow interior with no material other than the head striking surface 12 to be applied in striking a golf ball. The head striking surface 12 is made of a sheet of taut, resilient material that is secured to a frame formed by the elliptical circumference of the back surface 11 of the putter head 10. The head striking surface is preferably canted at a slight inclined angle to the vertical, such as the 2 degrees of incline shown in FIG. 1, to provide a top spin to promote rolling of the golf ball. Due to the positioning of the rim 12*a* of a tubular body 20 and weighted tube section 20*a* inside the hollow interior of the putter head proximate the rear surface of the sheet material 12, the head striking surface has a "sweet spot" 12*b* for contact with the golf ball. The "sweet spot" has a profile equal to or larger than that of the golf ball to allow plenty of leeway to make the intended effect of contact with the ball. When the golf ball strikes the taut sheet material, the taut sheet material has a trampoline-like drumhead effect which propels the ball on a rebound trajectory that tends to return toward the target line TL aligned with the swing axis SX.

The trampoline-effect of the putter head striking surface is analogous to that of a trampoline as commonly used for sports or recreation. The frame of a typical sports trampoline is made of a rigid high-strength material such as steel. The trampoline bed is a high tensile strength sheet or woven fabric material which is stretched taut on the frame. The rebound force when a user jumps on the trampoline surface is provided by sheet material tensioned by the steel springs. The bed is made of a strong fabric selected to have very little stretch but a desired resiliency when impacted so that it tends to rebound under the spring pulling force with a return of all of the impact force. In addition, due to the geometry of the taut material of the bed, a body impact off the center of the bed will tend to have a stronger rebound pull on the shorter side nearer the frame than on the longer side more distant to the opposite side of the frame, resulting in the "trampoline-effect" of the rebound force having a vector turned back toward the center vertical line of the trampoline bed, thereby enabling the user to stay centered on the trampoline even if the jump is slightly off-center from the center vertical line of the bed.

By analogy, the taut sheet material of the putter head is selected to have a high-strength and resiliency under impact so that the golf ball tends to rebound with a return of all of the impact force vectored toward the center line (target line) of the head striking surface. Such strength and resiliency characteristics are obtained, for example, using carbon-fiber reinforced polymer or carbon fiber-reinforced plastic (CFRP or CRP) materials. Similar to fiberglass (glass reinforced polymer), the CFRP or CFP composite material employs carbon fiber as reinforcing fibers. The polymer is most often epoxy, but other polymers, such as polyester, vinyl ester or nylon, are sometimes used. Some composites contain both carbon fiber and other fibers such as Kevlar, aluminum, and fiberglass reinforcement. The terms graphite-reinforced polymer or graphite fiber-reinforced polymer (GFRP) are also used, but less commonly. One method of producing graphite-epoxy parts is by layering sheets of carbon fiber cloth into a mold in the shape of the final product. The alignment and weave of the cloth fibers is chosen to optimize the strength and stiffness properties of the resulting material. The mold is then filled with epoxy and is heated or air-cured. The resulting part is very corrosion-resistant, stiff, and strong for its weight. Parts used in less critical areas are manufactured by draping cloth over a mold, with epoxy either pre-impregnated into the fibers or "painted" over it.

Figure 2:
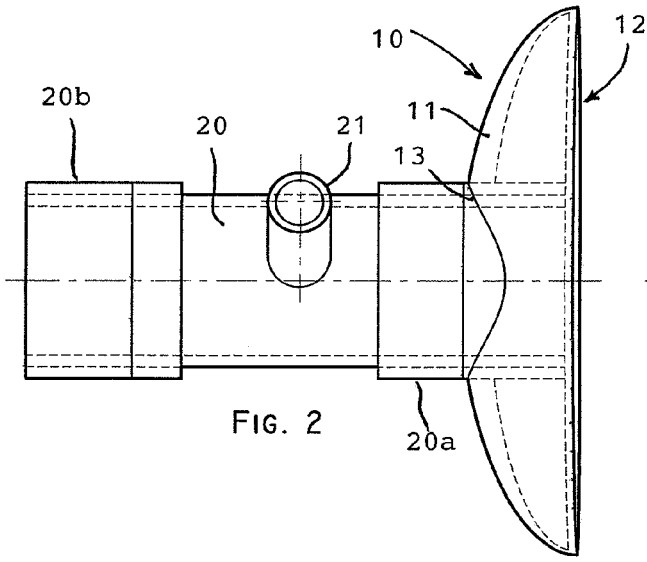
FIG. 2 is a top view of the improved golf putter design.
Figure 3:
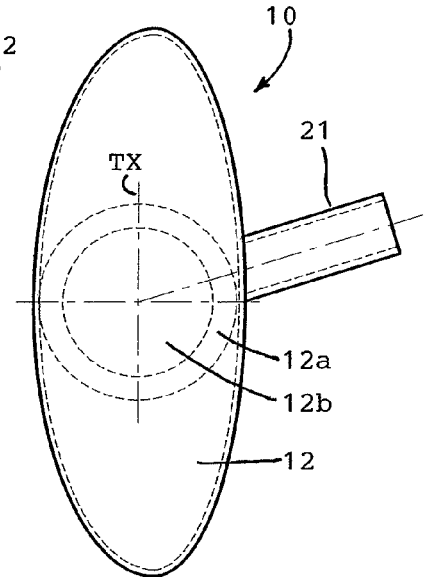
FIG. 3 is a face view of the improved golf putter design.
Figure 4:
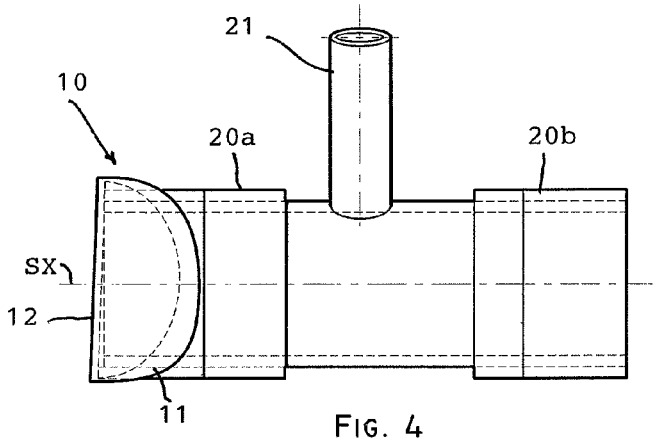
FIG. 4 is a left side view of the improved golf putter design.

The body of the putter consists of a hollow, elongated tubular body 20 having its tubular axis and weight oriented along the swing axis of the putter head. This is different from typical modern day putters which tend to have a large putter head with weight distributed in a plane behind the striking surface in an attempt to balance the weight of the putter head along the transverse axis. As shown in FIG. 2, the tubular body 20 may have adjustable weights to provide the putter with a desired sufficient swing weight for good stability and "feel" for the user's putt swing. In a preferred design, the opposite ends of the tubular body 20 are telescoped over or into front and back tube sections 20*a*, 20*b*, respectively, for adding a desired amount of weighting. The telescoped tube sections can be formed with different lengths, wall thicknesses, or material depending on the desired weight and distribution between front and back portions of the putter body.

Figure 6:
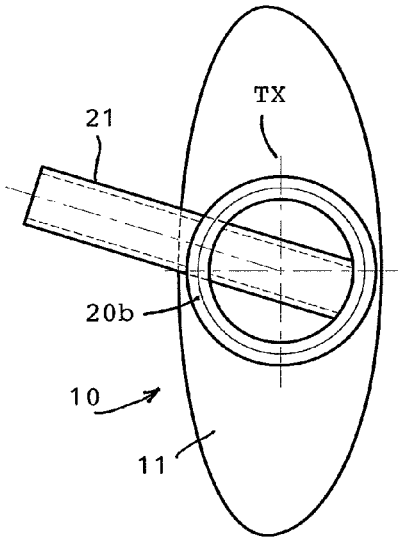
FIG. 6 is a back view of the improved golf putter design.
Figure 5:
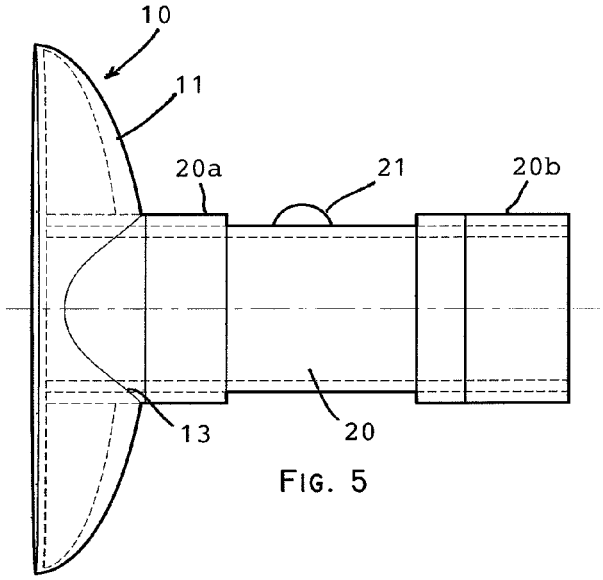
FIG. 5 is a bottom view of the improved golf putter design.

The front end of the tubular body 20 is fitted through a central aperture 13 and inserted until the rim of the front end of the tubular body 20 and tube section 20*a* are abutting the rear surface of the resilient sheet material (see FIGS. 3 and 5), thereby forming a circular "sweet spot" of taut sheet material as the head striking surface. Stabilization of the sheet material may be reinforced by sealing the rear surface of the sheet material with a layer of epoxy or other adhesive to the rim of the front tube section. The back end of the tubular body is open to air, as illustrated in FIG. 6, so that the trampoline-effect of the resilient sheet is optimized for air pressure balance. The orientation of the tubular body places all of its weight along the line of the swing axis so that any tendency of torquing of the putter head is minimized even if contact with the ball is made slightly off-center or off the swing line.

Figure 7A:
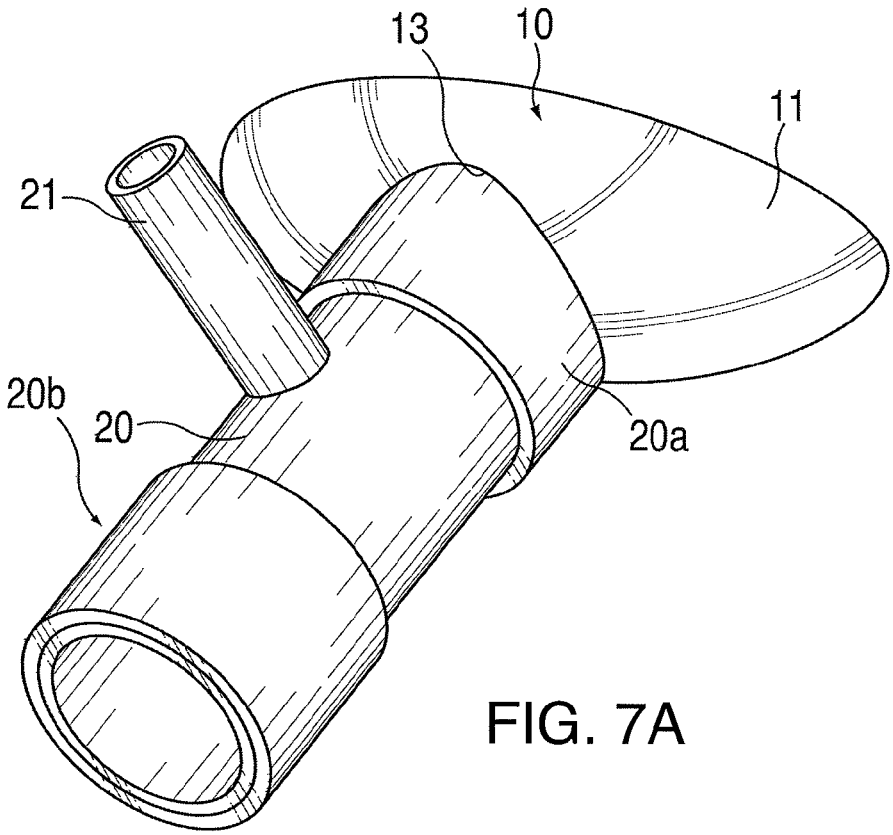
FIG. 7A is a rear 45-degree perspective view of the improved golf putter design.
Figure 7B:
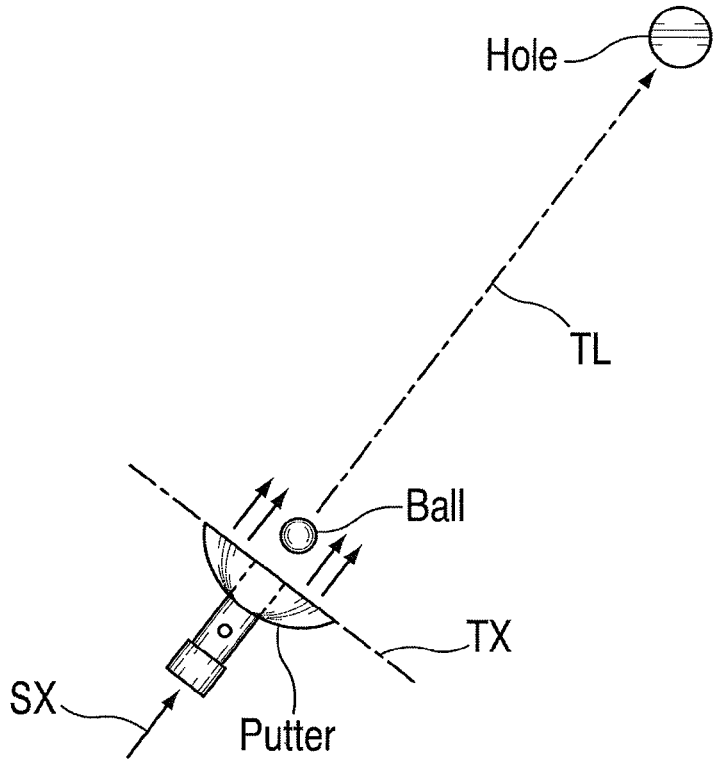
FIG. 7B illustrates the alignment of the putter head with the swing axis and target line of the putter.

FIG. 7A shows a rear 45-degree perspective view of the improved golf putter design, and FIG. 7B illustrates the alignment of the putter head with the swing axis SX and target line TL for the putter to stroke a golf ball to a target hole. The tendency of the golf ball to rebound with a vector toward the target line TL is indicated by arrows inclined to the TL.

As an example of a preferred implementation of the improved putter design, the elliptical frame formed by the back surface 11 of the putter head 10 is made oversized with a long axis diameter of about 5.5 inches on the transverse axis and a short axis diameter of about 1.8 inches in the vertical direction, compared to a standard golf ball of 1.68 inches diameter. The sheet material for the head striking surface on the front of the putter face is formed as a composite layer of ultra-light foam coated with ultra-strong carbon fiber. Preferably it has a paperstock-like thinness (such as 500 to 2000 microns) to utilize the full resiliency of the sheet material in returning all (or almost all) of the striking force on rebound. The composite sheet material can be fabricated by heat sealing the sheet material with a thermally fusible adhesive layer to the circumferential rim forming the elliptical frame of the back surface of the putter head. As the heat-sealed sheet material cools to ambient temperature, the material contracts slightly, thereby pulling it taut on the elliptical frame to form the desired head striking surface with trampoline-effect. A black carbon fiber color will give the club a high-tech panache and appeal.

Figure 8:
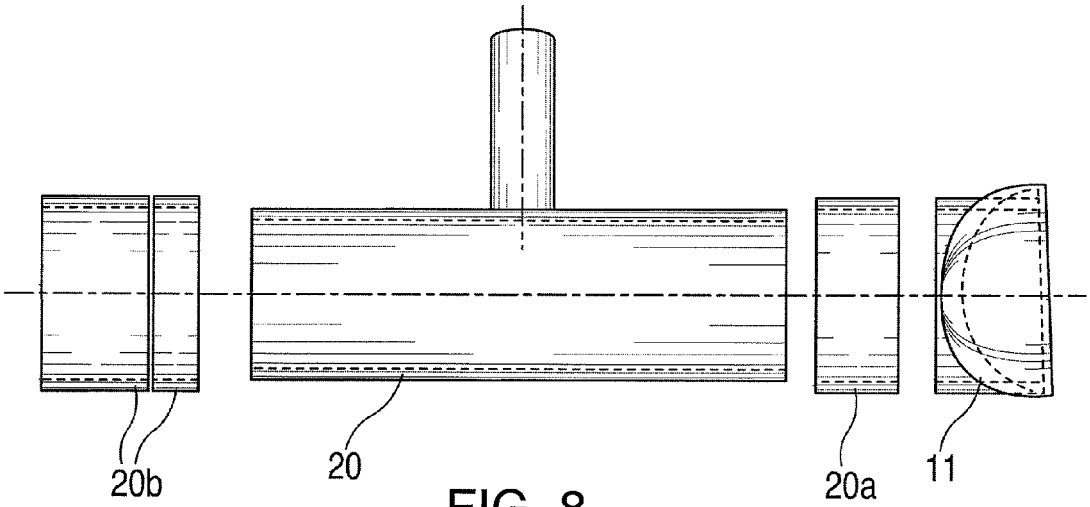
FIG. 8 is a schematic exploded view of the putter head and body.

The main tubular body may be between 5 and 6 inches long, preferably 5.5 inches in length, and has an inner diameter of 1.64 inches which is slightly smaller than a golf ball, so that when the rear end of the tubular body is used to pick up a golf ball, it avoids becoming jammed inside it. The tubular body may be made of burnished copper to give it a high-tech look. As illustrated in FIG. 8, the telescoping tube sections 20*a*, 20*b* may be formed as cylindrical weights that telescope with a friction fit over the ends of the main tubular body 20 so that the owner can adjust the weighting for a desired heft of the putter to suit putting style. Positioning of the weights in different locations along the tube can also be subjectively made available to the owner for feel.

Figure 9:
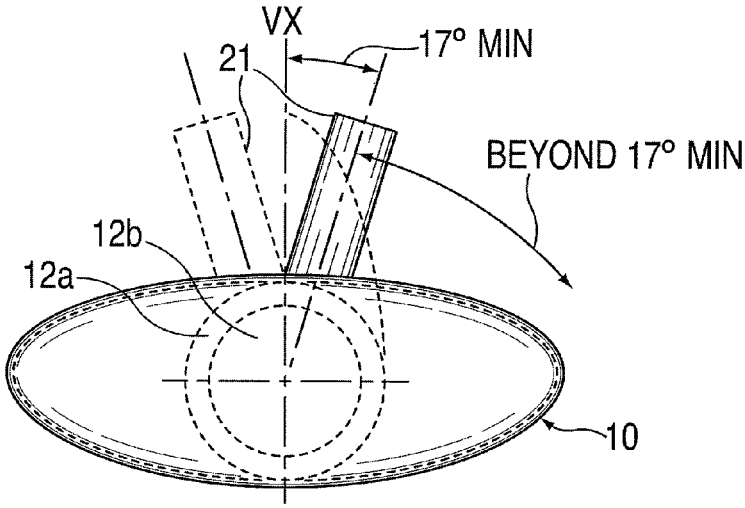
FIG. 9 is a schematic face view of the putter head relative to the shaft.
Figure 10:
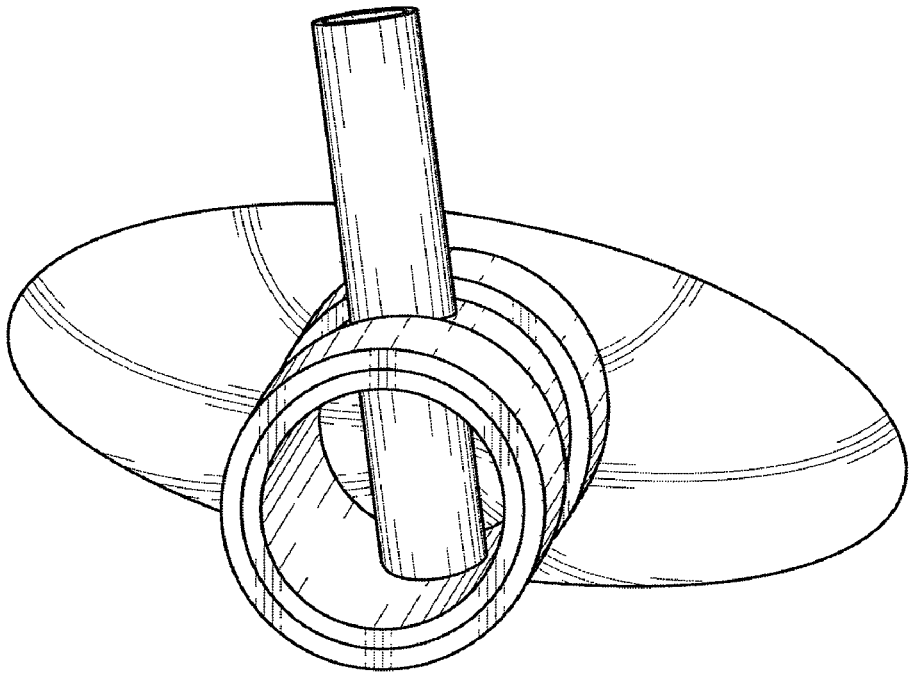
FIG. 10 is a rear perspective view of the assembled putter.
Figure 11:
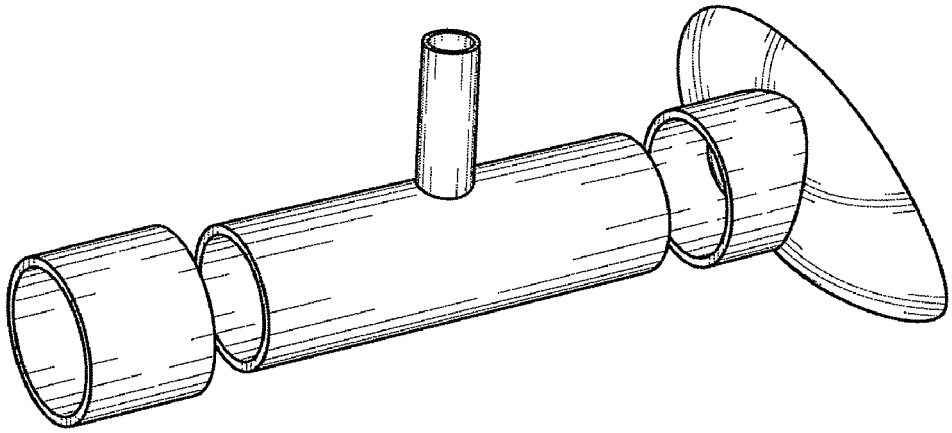
FIG. 11 is an exploded perspective view of the putter head and body.
Figure 12:
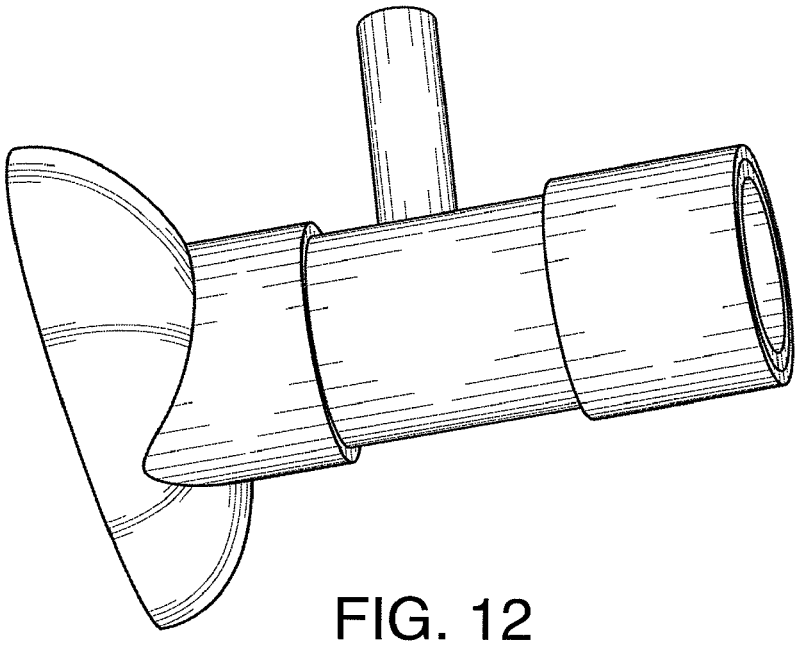
FIG. 12 is a bottom 45-degree perspective view of the assembled putter.
Figure 13:
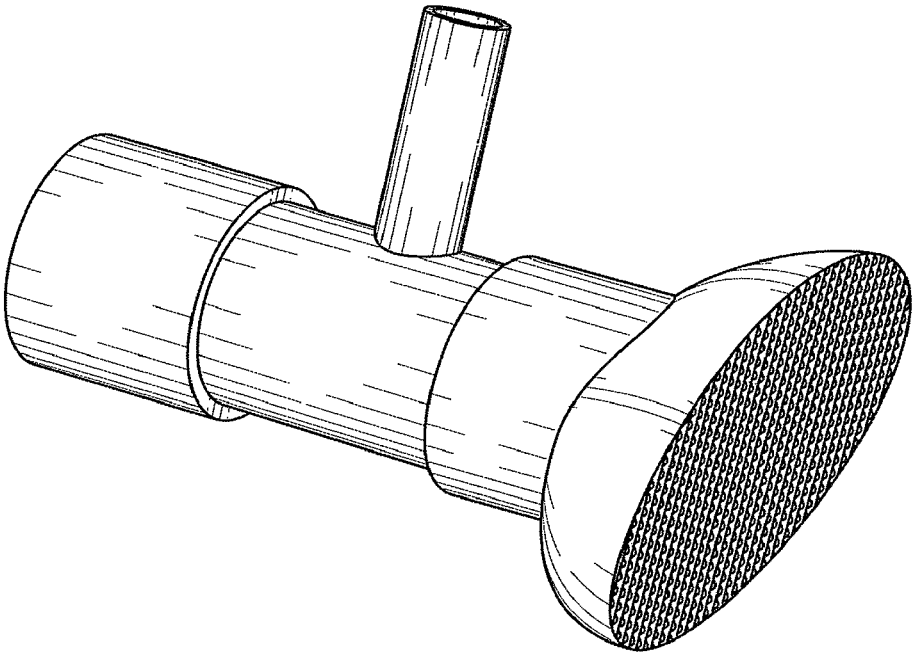
FIG. 13 is a top 45-degree perspective view of the assembled putter.

The telescoped front tube section is press-fitted into the rear aperture 13 of the putter head and is rotatable relative to the main tubular body which adjoins the hosel holding the putter shaft. This allows the angular orientation of the putter head to be easily and infinitely adjustable for lie, as long as it is a minimum of 17 degrees as required by standard golf equipment rules. As illustrated in FIG. 9, the hosel angle can be adjusted to either side of the vertical axis VX for left or right-handed golfers (not a fixed angle which might otherwise need to be adjusted by a golfsmith). Index markings may be provided on the front tube section relative to a reference pointer on the main tube for convenient adjustment. A bright shiny copper or stainless steel tube (set off against the black carbon fiber head and black graphite shaft) will give the putter an exceptionally attractive look.

In FIG. 9, the sweet spot 12*b* of the head striking surface is defined by the rim 12*a* of the tubular body and section (1.74 inch outer diameter, 1.64 inch inner diameter) abutting the rear surface of the sheet material so that it acts like a drum face located in the center of the 5.5 inch wide, elliptical putter face. The drum face forming the sweet spot of the head striking surface will facilitate a modest trampoline effect giving great feel and straight top-spin action to the putting. Due to the open-end hollow tube being in line with the direction of travel, there will be an interesting sound response when the ball is struck in the sweet spot. A flatter sound will result on an off-center hit. These sounds will constantly yet subtly help reinforce the user's feel for a proper contact.

FIGS. 10-13 are rear perspective, exploded perspective, bottom 45-degree perspective, and top 45-degree perspective views, respectively, of the fully assembled putter head of the improved design.

It is to be understood that many modifications and variations may be devised given the above description of the general principles of the invention. It is intended that all such modifications and variations be considered as within the spirit and scope of this invention, as defined in the following claims.

The invention claimed is:

1. An improved design for a golf putter, comprising:

a putter head having a back surface formed in an elliptical shape elongated along a transverse axis normal to a swing plane for the putter, said back surface enclosing a hollow interior and having a circumferential rim forming an elliptical frame for the putter head;

the putter head having a front surface as a head striking surface formed with a sheet of taut, resilient material secured to the elliptical frame formed by the circumferential rim of the back surface of the putter head, wherein the head striking surface has a drum effect when it makes contact with a golf ball and tends to return the ball's rolling trajectory to the target line of the swing axis even if contact with the ball is made off-center; and a putter body formed with an elongated tubular body having its tubular axis oriented in the direction of the swing axis for the putter head, so that the peripheral weight of the putter becomes aligned in the direction of the swing axis in order to create a pendulum plumb-bob effect of weight moving under the effect of gravity aligned in the swing direction.

2. An improved design for a golf putter according to claim 1, wherein a front end of the tubular body is fitted through a central aperture in the back surface of the putter head and inserted in the hollow interior until a tubular rim of the front end of the tubular body abuts a rear surface of the taut, resilient sheet material, thereby forming a circular "sweet spot" on the head striking surface.

3. An improved design for a golf putter according to claim 2, wherein the taut, resilient sheet material is stabilized by sealing the rear surface of the sheet material with a layer of epoxy or other adhesive to the rim of the tubular body.

4. An improved design for a golf putter according to claim 2, wherein an opposite back end of the tubular body is open to air, so that the drum effect of the resilient sheet material is optimized for air pressure balance.

5. An improved design for a golf putter according to claim 2, wherein the sweet spot of the head striking surface has a diametral profile equal to or greater than a diametral profile of a golf ball.

6. An improved design for a golf putter according to claim 1, wherein the tubular body has a provision for adjusting the overall weight and weight distribution of the putter head.

7. An improved design for a golf putter according to claim 6, wherein the provision for adjusting the overall weight and weight distribution is comprised of telescoped front and back tube sections that sleeve over or inside respective ends of the tubular body.

8. An improved design for a golf putter according to claim 7, wherein a front end of the tubular body and telescoped front tube section are fitted through a central aperture in the back surface of the putter head and inserted in the hollow interior until a tubular rim of the front end of the tubular body and telescoped front tube section abut a rear surface of the taut, resilient sheet material, thereby forming a circular "sweet spot" on the head striking surface.

9. An improved design for a golf putter according to claim 8, wherein the taut, resilient sheet material is stabilized by sealing the rear surface of the sheet material with a layer of epoxy or other adhesive to the rim of the telescoped front tube section.

10. An improved design for a golf putter according to claim 8, wherein the front tube section is telescoped over the front end of the tubular body and press-fitted into the central aperture in the back surface of the putter head, wherein said main tubular body is rotatable relative to said front tube section and adjoins a hosel for holding a putter shaft, whereby an angular orientation of the putter head relative to the putter shaft can be adjusted for lie.

11. An improved design for a golf putter according to claim 10, wherein index markings are provided on the front tube section relative to a reference pointer on the tubular body for conveniently guiding adjustment thereof.

12. An improved design for a golf putter according to claim 7 wherein the telescoped tube sections are formed with adjustable weights by one or more of the group of parameters consisting of: section lengths, wall thicknesses, materials, and distribution of weight between front and back ends of the tubular body.

13. An improved design for a golf putter according to claim 1, wherein the head striking surface is canted at a slight inclined angle to the vertical direction to provide top spin to promote rolling of the golf ball.

14. An improved design for a golf putter comprising:

a putter head having a back surface with a central aperture therein and a front head striking surface; and a putter body formed with an elongated tubular body having a front end inserted into the central aperture in the back surface of the putter head and its tubular axis oriented in the direction of the swing axis for the putter head, so that the peripheral weight of the putter becomes aligned in the direction of the swing axis in order to create a pendulum plumb-bob effect of weight moving under gravity aligned in the swing direction, wherein the back surface of the putter head is formed in an elliptical shape elongated along a transverse axis normal to a swing plane for the putter, said back surface enclosing a hollow interior and having a circumferential rim forming an elliptical frame for the putter head, and wherein the head striking surface of the putter head is formed with a sheet of taut, resilient material secured to the elliptical frame formed by the circumferential rim of the back surface of the putter head, such that the head striking surface has a drum effect when it makes contact with a golf ball and tends to return the ball's rolling trajectory to the target line of the swing axis even if contact with the ball is made off-center.

15. An improved design for a golf putter according to claim 14, wherein the front end of the tubular body is fitted through the central aperture in the back surface of the putter head and inserted in the hollow interior until a tubular rim of the front end of the tubular body abuts a rear surface of the taut, resilient sheet material, thereby forming a circular "sweet spot" on the head striking surface.

16. An improved design for a golf putter according to claim 14, wherein the tubular body has a provision for adjusting the overall weight and weight distribution of the putter head.

17. An improved design for a golf putter according to claim 16, wherein the provision for adjusting the overall weight and weight distribution is comprised of telescoped front and back tube sections that sleeve over or inside respective ends of the tubular body.

18. An improved design for a golf putter according to claim 17, wherein the telescoped tube sections are formed with adjustable weights by one or more of the group of parameters consisting of: section lengths, wall thicknesses, materials, and distribution of weight between front and back ends of the tubular body.

* * * * *